US006405183B1

(12) United States Patent
Bass et al.

(10) Patent No.: US 6,405,183 B1
(45) Date of Patent: Jun. 11, 2002

(54) METHOD AND SYSTEM FOR AUTOMATICALLY TRANSFERRING INFORMATION IN A DATA PROCESSING CENTER

(75) Inventors: Edward R. Bass, Trumbull; James P. Maher, Milford, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/455,269

(22) Filed: Dec. 6, 1999

(51) Int. Cl.[7] ..... G07B 17/00

(52) U.S. Cl. ..... 705/409; 705/401; 705/403; 705/404

(58) Field of Search ..... 705/409, 410, 705/404, 10, 401, 26, 35, 408; 380/55; 709/402; 707/4; 703/403

(56) References Cited

U.S. PATENT DOCUMENTS 4,718,506 A 1/1988 Hills ..... 177/25
5,710,706 A * 1/1998 Markl et al. ..... 705/409
5,712,787 A * 1/1998 Yeung ..... 705/10
5,717,596 A * 2/1998 Bernard et al. ..... 705/404
5,778,348 A * 7/1998 Manduley et al. ..... 705/409
5,805,711 A * 9/1998 Windel et al. ..... 380/55
5,852,813 A * 12/1998 Guenther et al. ..... 705/408
5,913,210 A * 6/1999 Call ..... 707/4
6,009,413 A * 12/1999 Webber et al. ..... 705/26
6,041,319 A * 3/2000 Bass et al. ..... 705/409
6,047,264 A * 4/2000 Fisher et al. ..... 705/26
6,064,994 A * 5/2000 Kubatzki et al. ..... 705/410
6,128,602 A * 10/2000 Northington et al. ..... 705/35

* cited by examiner

*Primary Examiner*—Zarni Maung
*Assistant Examiner*—Jungwon Chang
(74) *Attorney, Agent, or Firm*—Karin A. Russo; Steven J. Shapiro; Angelo N. Chaclas

(57) ABSTRACT

A method and system for automatically transferring information in a data processing system, including setting a counter within a data processing device to a predetermined time period and counting the predetermined time period based upon a real time clock maintained within the data processing device. When the counter reaches the predetermined time period, the data processing device automatically initiates a data center connection and requests an information transfer. The data center transfers information to/from the data processing device. The data processing device activates the transferred information, which can then be used by the data processing device. Typical data processing systems include weighing systems, in which frequently changing postal rates and carrier rates are used to determine mail piece and parcel delivery cost, facsimile or other information accumulation systems.

7 Claims, 5 Drawing Sheets

METHOD AND SYSTEM FOR AUTOMATICALLY TRANSFERRING INFORMATION IN A DATA PROCESSING CENTER

FIELD OF THE INVENTION

The present invention relates generally to the field of information transfer between devices, specifically automatic information transfer within a data processing system. More particularly, the present invention relates to automatically transferring information between a data processing center and a data processing device such as a weighing device, a facsimile machine or other device requiring information transfer.

BACKGROUND OF THE INVENTION

Data processing systems often rely on, or require, the ability to operate under changing environments and/or changing or updated information. When systems require changing environments and/or changing or updated information, it is also important to assure that the system be provided the most accurate information. Therefore, timely transfer and activation of the information is necessary in order to ensure the accuracy of such systems. In furtherance of this effort, certain information transfer methods have been devised and implemented.

One such method is disclosed in U.S. Pat. No. 4,718,506 issued on Jan. 12, 1988 and assigned to Pitney Bowes Inc., entitled "PROM CARD ARRANGEMENT FOR POSTAU-SHIPPING SCALE" and describes storing look-up tables in a programmable read only memory device (PROM) to provide an information receiving device with the latest and most accurate information. In order to transfer information, the information provider must create a new PROM containing that information, and ship the PROM to the user. The user must then physically remove the old PROM and install the new PROM into the device. Other prior art systems employ a flash PROM or a floppy disc to store and transport updated information. Still other systems, such as that described in U.S. Pat. No. 5,778,348 issued on Jul. 7, 1998 and assigned to Pitney Bowes Inc., entitled "REMOTE ACTIVATION OF RATING CAPABILITIES IN A COMPUTERIZED PARCEL MANIFEST SYSTEM," discloses storing a number of active postal rate tables in a memory, disabling access to certain tables and enabling access to other tables.

The prior art systems discussed, however, do not provide automatic information transfer from a data center to a data processing device. Furthermore, these prior art systems are costly and are subject to time delays caused by both the shipping and installation of the PROM. A significant inconvenience and inaccuracy related to unreliable information may also arise from the inability to keep track of which users have received updated information and which users still require updated information. The inaccurate record keeping is also a problem when accounting for billing purposes. The time delay caused by inaccurate record keeping potentially costs both users and providers in the form of lost profit, lost business, or increased business expense.

An example of one such system requiring updated information is a weighing system, such as a carrier/shipping scale, having the capability of calculating charges based on the sensed weight or size of a parcel or mail piece and the corresponding carrier rating information. These weighing systems require specific postal rate information, without which a mail piece may be returned for insufficient postage or a carrier manifest rejected as inaccurate; thus resulting in delayed delivery and/or increased cost. Postal rates and carrier rates are set by each country's postal regulation systems (such as the Unites States Postal Service or the Royal Post Office for the United Kingdom) or carrier regulations respectively. These entities are frequently changing their requirements. These changes must then be communicated to the systems and people relying upon the rate determination. These systems therefore operate in many languages, currencies, and time zones.

Other such groups of systems requiring information transfer are data accumulation and facsimile systems, which rely upon certain updated information such as name tables. As well, these systems often require additional software and/or upgrades to system information; thus, automatic transfer of that information may be of interest.

BRIEF SUMMARY OF THE INVENTION

According to the invention, automatic request, transfer and verification of information at reduced cost is achieved by providing a data processing system having a data center and a data processing device. The data processing device further includes a modem, a real-time clock and a counter. The counter may be counting time either by an ascending or a descending time clock. When the counter reaches a predetermined count, the data processing device prompts the system to communicate with the data center to request an information transfer. Information transfer occurs if the data center determines that the data processing device requires such a transfer. The information determined to be transferred is based upon the uniquely identified data proceesing device. Upon completion of, the transfer, the information is verified and activated as available for use.

In typical systems, the data processing device is shipped to a user with information to allow communication within its internal memory. During initial installation, the user connects the device to the data center via a communication line, preferably a telephone line. During the initial installation, certain information will be entered into the non-volatile memory located in the device. Such information that may be entered includes the current date and the time. Other information that may be provided are: the country, language, zip code and area code where the device is located. Also at this time, the counter is set to a predetermined count such that the counter will either count on an ascending or descending basis to the designated time period. Preferably, a time period of at least thirty (30) days is provided.

During initial installation, the data processing device identifies itself to the data center using its product code number (PCN) and serial number. This unique information is used to identify not only the device but also the specific user corresponding to the device. Once the data processing device identification is complete, the information transfer is enabled. Another feature of the unique identifier is that it enables the data center to determine what information the device requires during transfer. The data center maintains a record of each information transfer in an effort to ensure that subsequent transfers are not duplicates, while also preventing gaps between information transfer. Once the initial transfer is complete, the system operates in its normal capacity.

Typically, under normal operation, the counter maintains a count until it reaches the predetermined setting. At that time, if the device is properly connected to the data center, the device software will initiate contact with the data center, identify the PCN and serial number, and request information transfer. Information determined for transfer is based on the identity of the data processing device and the parameters entered by the user. If the device is not properly connected to the data center, the device will request the user to establish the proper communication connection. In the preferred embodiment, the indicator is a text display such as a liquid crystal display (LCD); however, the indicator may also be a sound or light indicator.

If the required information is available at the time of the device request, then the data center will transfer the information. If, however, the information is not available at the time of the device request but a date when the information will become available is known, then the data center will reset the counter to initiate communication with the data center at that new date and time. If the transfer does occur, then the counter is still reset in order to allow future automatic information transfer.

Upon completion of the information transfer, the device application software compares the effective date of the transferred information with the current date as indicated by the real time clock. If the comparison reveals that the dates either match or that the dates are in the past, the information is activated and the data processing device is directed to operate under the activated information. If, however, the date is a future date, then the device application software will not activate the new information until the dates match the real time clock. It is important to note that the information transfer or activation does not delete the existing information from the memory in case there is some subsequent reason for the information use or documentation. A record of the devices that were contacted and/or transfer data is maintained at the data center. Record keeping for both billing purposes and information accuracy is therefore, enhanced.

Other objects, features, and advantages of the invention will become apparent from the following description of specific embodiments when read in conjunction with the accompanying drawings.

DETAILED DESCRIPTION OF THE PREFERRED EMBODIMENT

Figure 1:
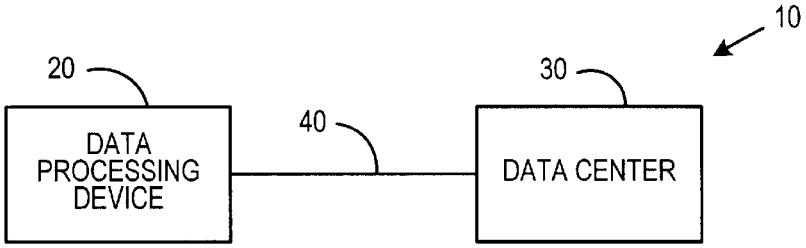
FIG. 1 is a block diagram of the data processing system of the present invention.

Referring now in detail to the drawings, and more particularly to FIG. 1, data processing system 10 includes data processing device 20 operatively connected through communication line 40 with data center 30. Data center 30 may be a personal computer, a network or the like. In the preferred embodiment, data processing device 20 is a weighing device such as one of the series of INTEGRA II™ scales manufactured by Pitney Bowes Inc. of Stamford, Conn. However, data processing device 20 may also be, for example, a facsimile machine or other system in which information transfer is desired.

Figure 2:
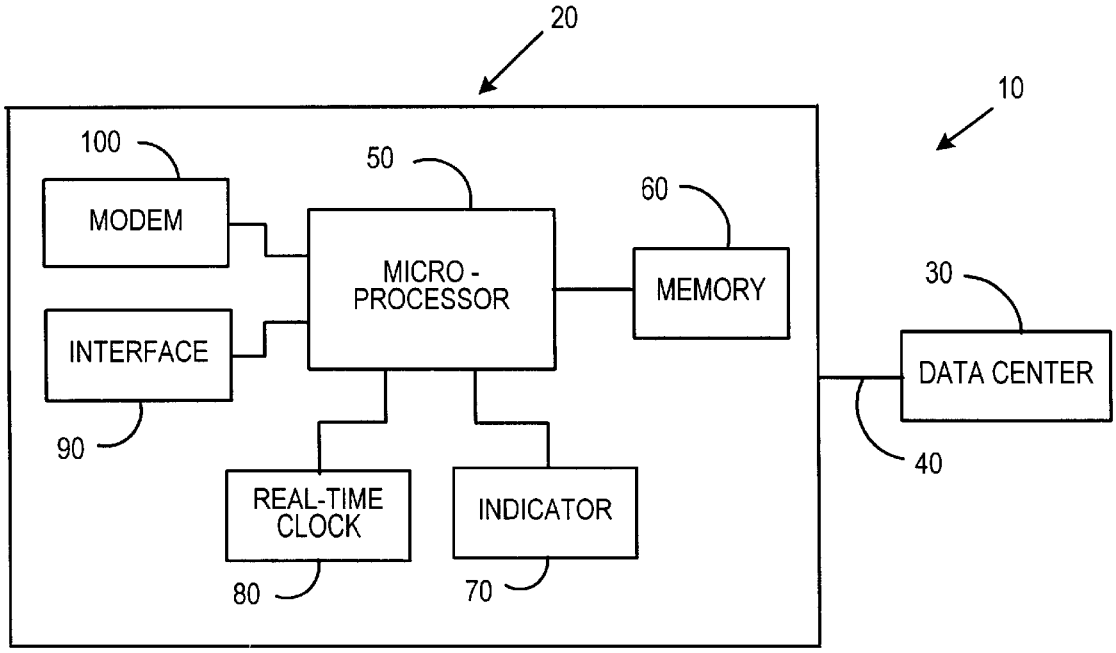
FIG. 2 is a detailed block diagram of the data processing system of the present invention.

As shown in FIG. 2 data center 30 is operatively connected through communication line 40 with data processing center 20. Data processing device 20 includes microprocessor 50 operatively connected to; memory 60, indicator 70, realtime clock 80, human interface 90, and modem 100. Memory 60 further includes: flash memory where data may be transferred for storage, electronically erasable memory, such as an electronically erasable read only memory (EEPROM) where a counter is located, and read access memory (RAM) for temporary storage. Typically, indicator 70 is a liquid crystal display (LCD) screen or a monitor, however, indicator 70 may be an LED or sound indicator. Real time clock 80 maintains the current time and is set upon initial activation. In a typical operation, the interface 90 is a keyboard, however, a touch screen or a voice recognition system may also be implemented.

Figure 3:
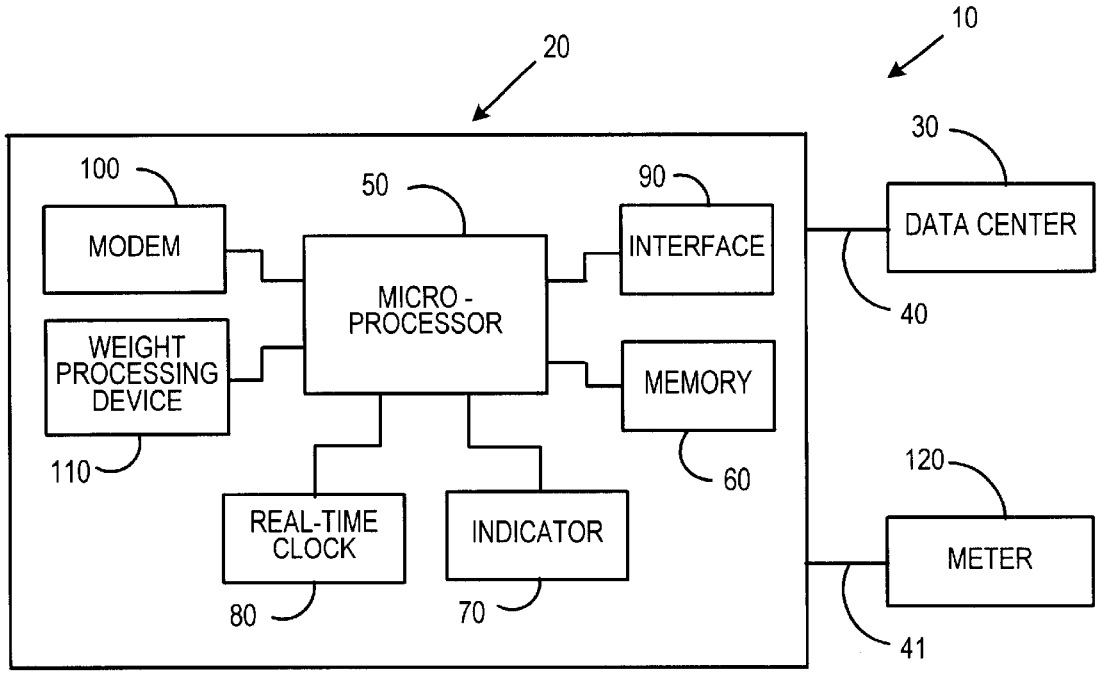
FIG. 3 is a detailed block diagram of the preferred embodiment of the present invention.

Now turning to FIG. 3, a block diagram of the data processing system 10 of the preferred embodiment of the present invention is shown.

The data processing device 20 of the present invention is a weighing device. Data processing device 20 is a typical weighing device of the preferred embodiment, which further includes weight-processing device 110, such as, for example, a scale. Weight processing devices are known in the art and need not be further described for an understanding of the present invention. Also in the preferred embodiment is postage meter 120 for imprinting postal indicia responsive to the data processing system of the present invention. Postage meter 120 is operatively connected via cable 41. Cable 41 may be an ECHOPLEX cable or RS232 cable or RF/wireless to data processing device 20. Postage meters are known in the art and need not be described further for an understanding of the present invention. A typical postage meter of the present invention may be a Pitney Bowes B900 or R700.

Figure 4:
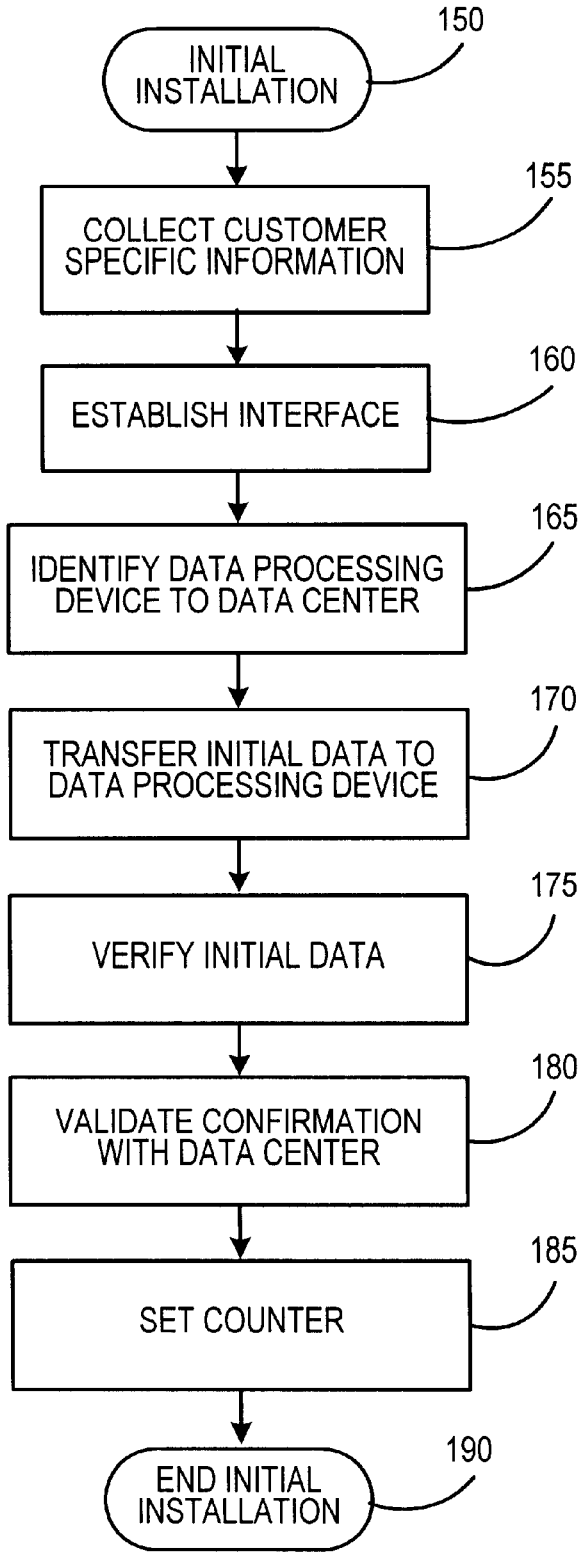
FIG. 4 is a flow chart describing the method and system of the present invention.

Now turning to FIG. 4, a flow chart of the initial installation of the data transfer system of the present invention is presented. During shipment, data processing device 20 will not contain any information within its internal memory 60 except for code required for start up. The required information will be supplied during the initial installation. The user starts initial installation at step 150. During installation, the user physically connects data processing device 20 via communication line 40(*a*) to data center 30. The process continues at step 155 where the user enters certain user-specific parameters. Such parameters may include the current date and times and may also include: country; language; area code; and, postal or zone codes for where the device will be used. This information will enable the system to access the rate tables and language under which to operate. The process then continues to step 160 where the user establishes a communication between data center 30 and data processing device 20. At step 165, date processing device 20 identifies itself to the data center using its product code number and serial number. This unique identification provides reference to a specific device, as well as to a specific customer.

Once the device identity is established at step 165, data center 30 transfers the device specific operating system at step 170. The initial data transfer is then verified at step 175 and, at step 180, confirmation of the transfer is communicated to the data center 30. The counter is set at step 185 and will serve in combination with the real time clock 80 as the basis for the automatic information transfer of the present invention. Initial installation ends at step 190, after which the system 10 will operate in its normal capacity.

Figure 5:
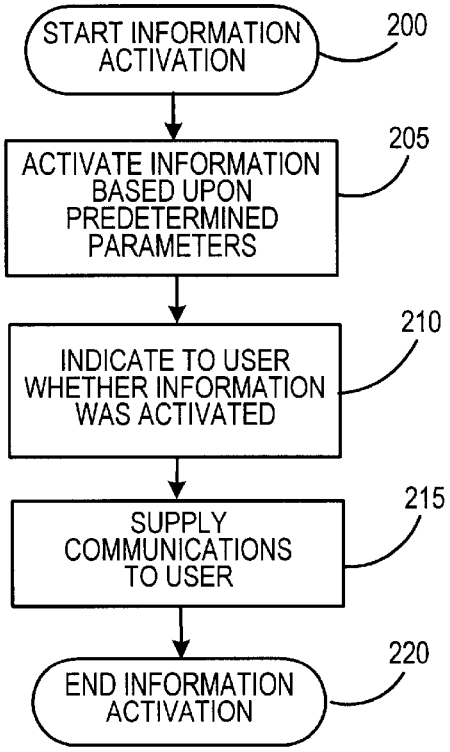
FIG. 5 is a flow chart of the information activation process of the present invention.

Activation of the initial information transfer of FIG. 4 is illustrated at FIG. 5. At step 200, the information activation starts and continues to step 205 where the system activates information based upon the predetermined parameters. At step 210, the system indicates to the user whether the information was activated. Thereafter, at step 215, the data center may provide other information to the user via indicator 70 of the device. The information may include: a help number; advertisements; billing information; or customer surveys. At step 220, the information activation process ends.

In the postal weighing system of the preferred embodiment, postal rates generally have effective dates for use after the information is transferred. Therefore, the actual use of the information would only be desirable subsequent to transfer; thus, the effective date is maintained in the device memory 60. When the effective date is the same as that of the real time clock, the information becomes active and the system software begins use of the transferred information.

Figure 6:
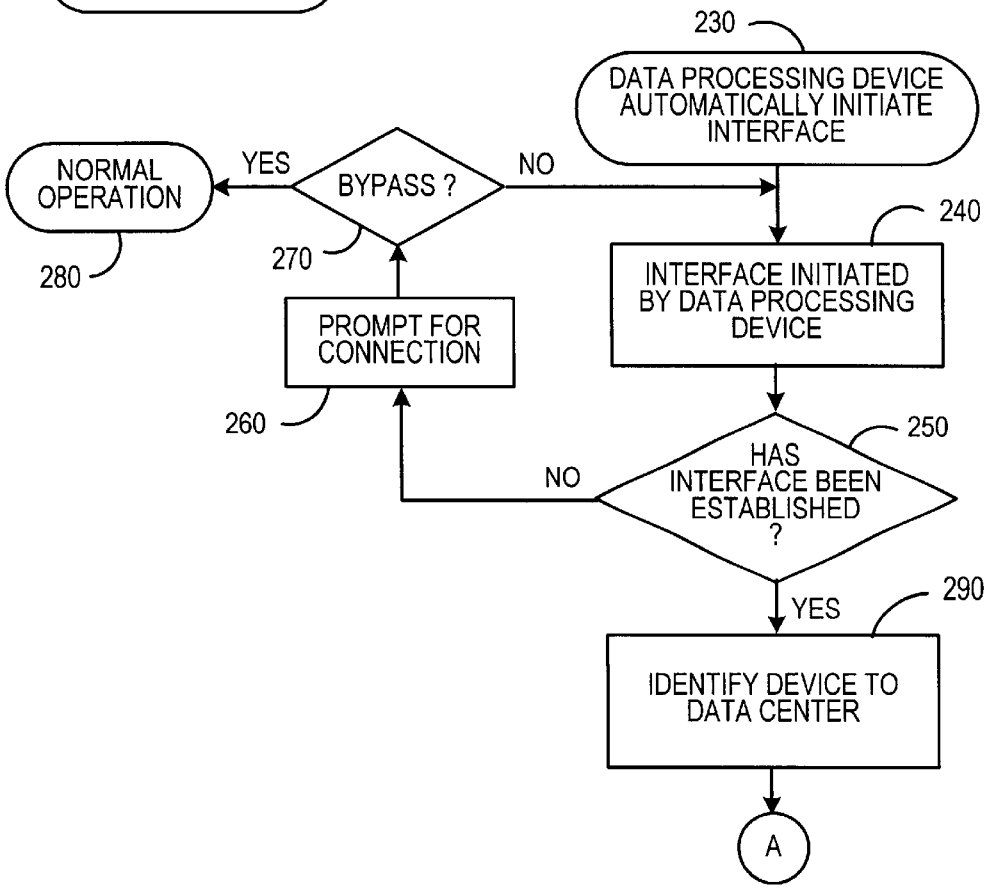
FIG. 6 is a flow chart of the automatic transfer of information of the present invention.

Now turning to FIG. 6, the flow chart illustrates the automatic information transfer of the present invention. At step 230, the automatic interface begins. Data processing device 20 automatically initiates an interface with the data center 30 at step 240. In typical operation of the automatic initiation, the real time clock 80 is continually maintaining the current time and date, and the counter uses the real time clock to maintain a count. Again, the counter counts either descending or ascending to a predetermined period set during the initial installation step previously set forth in FIG. 4 at step 185. Automatic initiation occurs when the counter reaches the preset period of time as determined by the real-time clock. At step 250, the device queries as to whether an interface has been established. If an interface has been established then the method proceeds to step 290 where data processing device 20 identifies itself to the data center. If an interface has not been established, the method proceeds to step 260 where the data processing device prompts the user to establish a connection via the communication line. At step 270, the user may choose to bypass the information transfer and, at step 280, operate the device using the existing information. Alternatively, at step 270, the user may choose to make the connection, thus causing data processing device 20 to again initiate an interface with the data center at step 240, and again query as to whether the interface has been established. If the response to this query is "yes," then the method proceeds to step 290 where data processing device 20 identifies itself to the data center. If the response is "no," then the method continues to prompt the user to either make a connection at step 260 or queries the user, at step 270, to bypass the connection. This continues until the user either makes a connection or chooses the bypass option. The flow chart then continues along path A to step 300 of FIG. 7.

Figure 7:
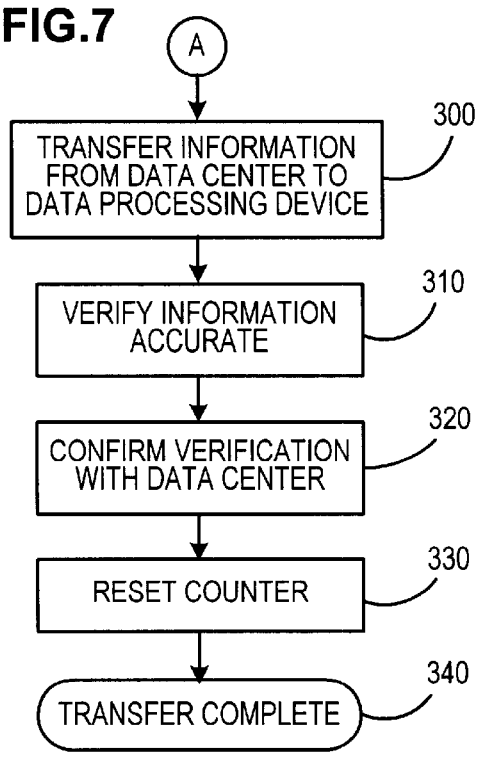
FIG. 7 is a continuation of the flow chart of FIG. 6.

Path A re-enters the method flow in FIG. 7 at step 300. At step 300, information is transferred between the data center 30 and the data processing device 20. At step 310, the information transfer is verified as being accurate and, at step 320, confirmed to the data center as being transferred. At step 330, the counter is reset. Counter reset is accomplished such that a new time period is established enabling future automatic information transfer. The counter reset is accomplished automatically as determined by either an indication within the transferred information or by default for a period of, for example, thirty (30) days. In the present invention, counter resetting is required to ensure the automatic information transfer. Information transfer is completed at step 340.

Figure 8:
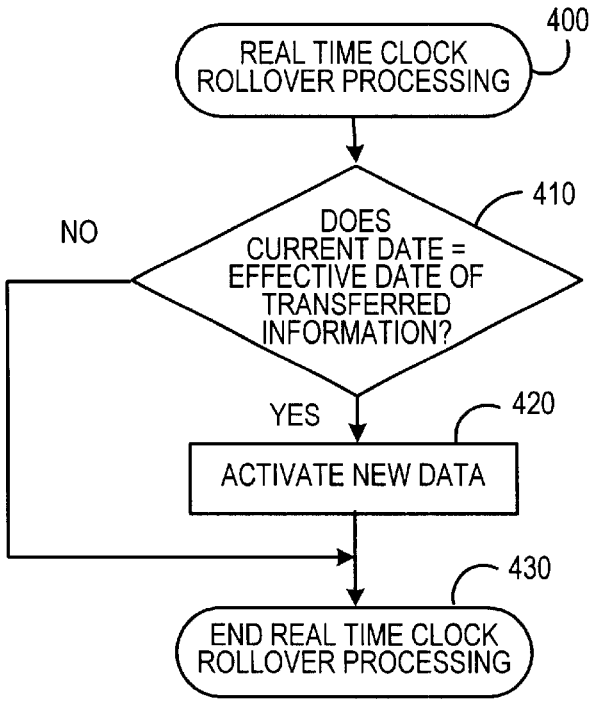
FIG. 8 is a flow chart of the new data activation of the present invention.

Now turning to FIG. 8, there is shown a flow chart describing the method for activating the information transferred in the data system. The method begins at step 400, where, based upon the real time clock roll over clock data, processing device 20 periodically queries the activation process. At step 410, the system queries as to whether the current date as maintained in the real time clock is the same as the effective date of the transferred information. If the answer to the query is "no," the process continues to step 430 where the real time process ends and the system continues with normal operation. If, however, the answer to the query is "yes," then at step 420 the new data is activated for use. The real time process then ends at step 430.

The above specification describes a new and improved system and method for automatically transferring information in a data processing system. It is realized that the above description may indicate to those skilled in the art additional ways in which the principles of this invention may be used without departing from the spirit of the invention. It is, therefore, intended that this invention be limited only by the scope of the appended claims.

What is claimed is:

1. A method for automatically transferring information in a data processing system, said method comprising the steps of:

(a) maintaining a first set of information at a data center within said data processing system;

(b) maintaining a data processing device within said data processing system;

(c) setting a counter, within a data-processing device, to a predetermined period of time;

(d) maintaining a real time clock within said data processing device whereby said counter counts to said predetermined period of time based upon said real time clock;

(e) automatically initiating interface to said data center from said data processing device when said counter reaches said predetermined period of time;

(f) determining at said data center that data transfer is required;

(g) transferring said first set of information to said data-processing device for use by said data processing device; and, (h) resetting said counter to a second predetermined period of time.

2. A method as claimed in claim 1, wherein said data center is a server.

3. A method as method as claimed in claim 1, wherein said data processing device is a weighing device.

4. A method as claimed in claim 1, wherein said data-processing device is a facsimile machine.

5. A method as claimed in claim 1, wherein said communication line is a telephone line.

6. A method as claimed in claim 1, wherein said first set of information includes postal rate tables.

7. A method as claimed in claim 1, wherein said first set of information includes carrier rate tables.

* * * * *